US007784658B1

(12) United States Patent
Hansen

(10) Patent No.: US 7,784,658 B1
(45) Date of Patent: Aug. 31, 2010

(54) BELT-CARRYING TOOL HOLDER

(76) Inventor: Michael D. Hansen, 1400 Lake St., North Mankato, MN (US) 56003

( * ) Notice: Subject to any disclaimer, the term of this patent is extended or adjusted under 35 U.S.C. 154(b) by 1087 days.

(21) Appl. No.: 11/456,205

(22) Filed: Jul. 9, 2006

(51) Int. Cl.
*A45C 1/04* (2006.01)
*A45F 5/00* (2006.01)

(52) U.S. Cl. ..... 224/674; 224/677; 224/678; 224/679; 224/680; 224/249

(58) Field of Classification Search ..... 224/674, 224/904, 250, 249, 667, 678, 679, 680; D3/228
See application file for complete search history.

(56) References Cited

U.S. PATENT DOCUMENTS 3,457,702 A * 7/1969 Brown ..... 54/44.1
3,497,119 A * 2/1970 Beeck ..... 224/275
5,456,357 A * 10/1995 Wenner et al. ..... 206/372
5,489,051 A * 2/1996 Robinson ..... 224/148.4
5,503,297 A * 4/1996 Frankel ..... 220/751
6,945,440 B1 * 9/2005 Ford ..... 224/148.6
7,314,153 B2 * 1/2008 Musarella et al. ..... 224/269

* cited by examiner

*Primary Examiner*—Nathan J Newhouse
*Assistant Examiner*—Lester L Vanterpool
(74) *Attorney, Agent, or Firm*—David A. Lingbeck

(57) ABSTRACT

A belt-carrying tool holder for supporting and conveniently carrying a staple hammer, staples and cutting knife. The belt-carrying tool holder includes a container assembly including a container having an opening and also including a lid being hingedly attached to the container and being closeable and fastenable over the opening of the container; and also includes a belt-receiving member being attached to the container; and further includes a tool-holding pocket being attached to the container; and also includes a tool-hanging assembly being pivotally attached to the container.

3 Claims, 2 Drawing Sheets

BELT-CARRYING TOOL HOLDER

BACKGROUND OF THE INVENTION

1. Field of the Invention

The present invention relates to a belt-supporting tool holders and more particularly pertains to a new belt-carrying tool holder for supporting and conveniently carrying a staple hammer, staples and cutting knife.

2. Description of the Prior Art

The use of belt-supporting tool holders is known in the prior art. More specifically, belt-supporting tool holders heretofore devised and utilized are known to consist basically of familiar, expected and obvious structural configurations, notwithstanding the myriad of designs encompassed by the crowded prior art which have been developed for the fulfillment of countless objectives and requirements.

While these devices fulfill their respective, particular objectives and requirements, the prior art not disclose a new belt-carrying tool holder. The prior art includes tool belt made of leather or flexible pouches with some of the prior art includes hangers which make it difficult for the user to insert and remove the particular tool from the hanger since the hanger freely pivots upwardly and downwardly unlike the present invention.

SUMMARY OF THE INVENTION

The general purpose of the present invention, which will be described subsequently in greater detail, is to provide a new belt-carrying tool holder which has many of the advantages of the belt-supporting tool holders mentioned heretofore and many novel features that result in a new belt-carrying tool holder which is not anticipated, rendered obvious, suggested, or even implied by any of the prior art belt-supporting tool holders, either alone or in any combination thereof. The present invention includes a container assembly including a container having an opening and also including a lid being hingedly attached to the container and being closeable and fastenable over the opening of the container; and also includes a belt-receiving member being attached to the container; and further includes a tool-holding pocket being attached to the container; and also includes a tool-hanging assembly being pivotally attached to the container. None of the prior art includes the combination of the elements of the present invention.

There has thus been outlined, rather broadly, the more important features of the belt-carrying tool holder in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new belt-carrying tool holder which has many of the advantages of the belt-supporting tool holders mentioned heretofore and many novel features that result in a new belt-carrying tool holder which is not anticipated, rendered obvious, suggested, or even implied by any of the prior art belt-supporting tool holders, either alone or in any combination thereof.

Still another object of the present invention is to provide a new belt-carrying tool holder for supporting and conveniently carrying a staple hammer, staples and cutting knife.

Still yet another object of the present invention is to provide a new belt-carrying tool holder that protects the staples from being damaged.

Even still another object of the present invention is to provide a new belt-carrying tool holder that provides easy and unhindered access to the staples and to a cutting knife and to the staple hammer; whereas, flexible tool belts makes it difficult for the user to insert and remove the tools when needed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
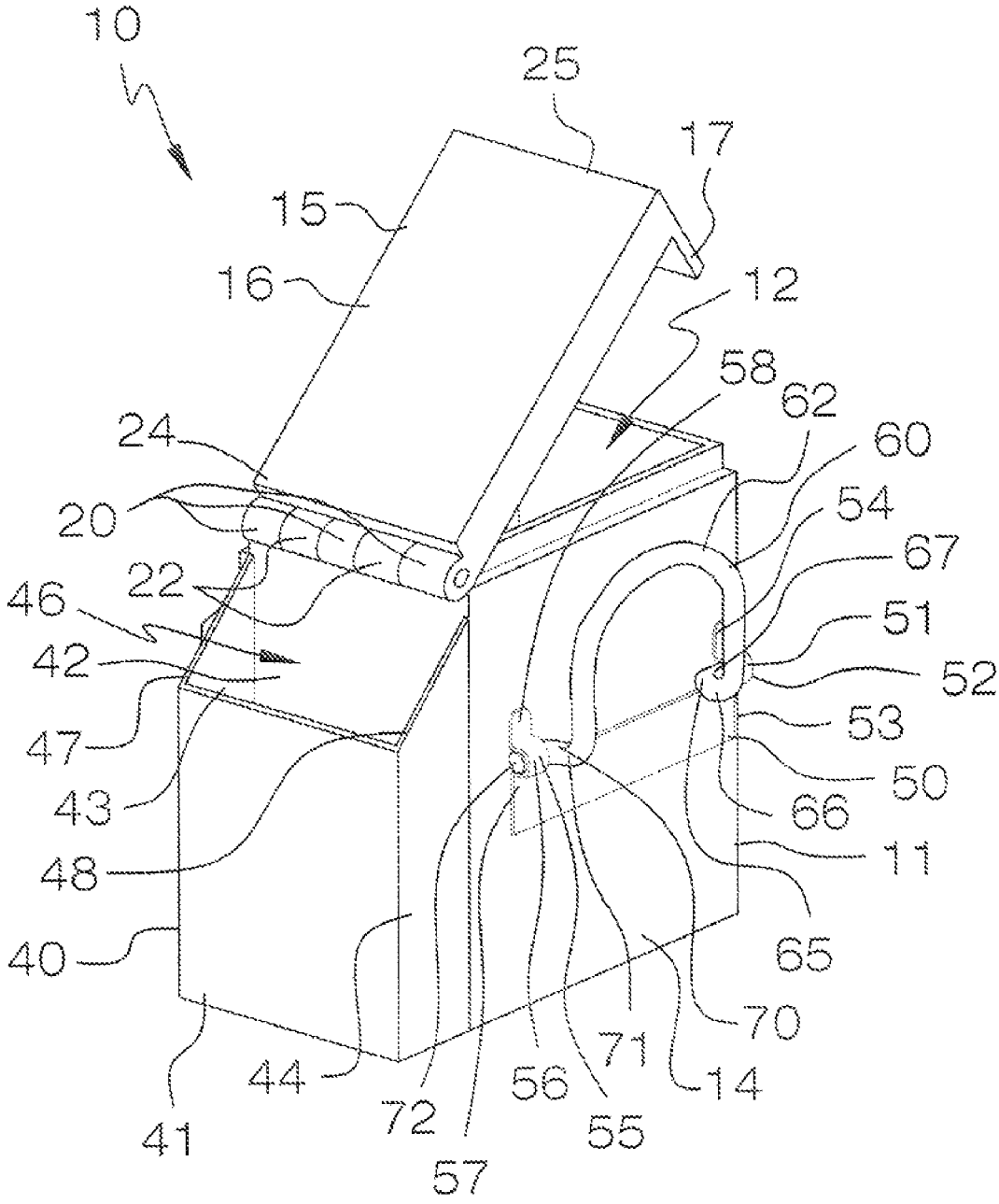
FIG. 1 is a top perspective view of a new belt-carrying tool holder according to the present invention.
Figure 2:
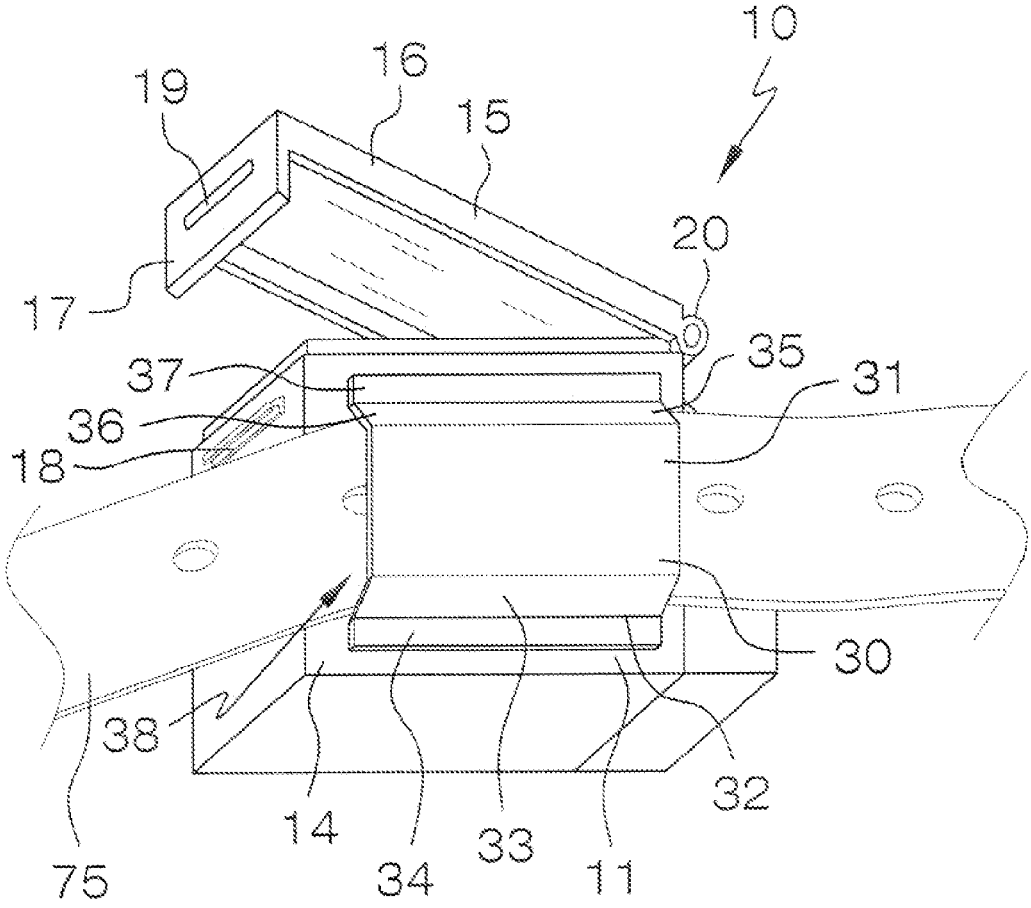
FIG. 2 is a bottom perspective view of the present invention.

With reference now to the drawings, and in particular to FIGS. 1 through 2 thereof, a new belt-carrying tool holder embodying the principles and concepts of the present invention and generally designated by the reference numeral 10 will be described.

As best illustrated in FIGS. 1 through 2, the belt-carrying tool holder 10 generally comprises a container assembly including a rigid container 11 having an opening 12 and also including a lid 15 being hingedly attached to the container 11 and being closeable and fastenable over the opening 12 of the container 11. The lid 15 includes a main portion 16 and a downwardly turned lip portion 17 being conventionally fastenable to the container 11. The container assembly also includes a lid-fastening member 18 being conventionally attached to an exterior of the container 11. The lid-fastening member 18 includes an elongate rib being disposed parallel to a top edge of the container 11. The downwardly turned lip portion 17 has an elongate slot 19 being disposed therethrough. The lid-fastening member 18 is removably received in the elongate slot 19 to fasten the lid 15 to the container 11 over the opening 12 to the container 11. The container assembly also includes a hinge assembly being conventionally attached to the container 11 and to the lid 15. The hinge assembly includes a plurality of first grommets 20 being axially-aligned and spacedly and conventionally attached to the container 11 near the opening 12 of the container 11, and also includes a plurality of second grommets 22 being axially-aligned and spacedly and conventionally attached to the lid 15 and being axially-aligned and interposed with the first grommets 20, and further includes a hinge pin 24 interconnecting the first and second grommets 20 & 22. The first grommets 20 are attached along a back end 24 of the main portion 16 of the lid 15, and the downwardly turned lip portion 17 extends from a front end 25 of the main portion 16 of the lid 15.

A belt-receiving member 30 is conventionally attached to the container 11. The belt-receiving member 30 is securely attached and bolted to the exterior of the container 11 and includes a rigid plate portion 31 and rigid end portions 32,35 extending from opposed ends of the rigid plate portion 31 and being fastened with bolts to the exterior of the container 11 to form a belt-receiving bore 38 between the container 11 and the rigid plate portion 31. Each of the rigid end portions 32,35 has a first section 33,36 which is angled relative to the rigid plate portion 31, and has a second section 34,37 which is angled relative to the first section 33,36 and which is disposed parallel to the rigid plate portion 31.

A tool-holding pocket 40 is conventionally attached to the container 11. The tool-holding pocket 40 includes rigid front, back, aide and bottom walls 41-45 and an open top 46. The back wall 42 of the tool-holding pocket 40 is securely and conventionally attached to the exterior of the container 11 below the hinge assembly. Each of the side walls 43,44 of the tool-holding pocket 40 has a top edge 47,48 which slants downwardly from the back wall 42 to the front wall 41 of the tool-holding pocket 40 to facilitate the retrieval of a cutting knife stored therein.

A tool-hanging assembly is pivotally attached to the container 11. The tool-hanging assembly includes a support plate 50 being securely and conventionally fastened to the exterior of the container 11, and also includes bracket members 50, 55 being spacedly and conventionally attached to the support plate 50, and further includes an arcuate rod 60 being pivotally supported by the bracket members 50,55. The arcuate rod 60 is pivotable upwardly to essentially rest against a side wall 14 of the container 11 near the opening 12 of the container 11 and also being pivotable downwardly to a position which is perpendicular to the side wall 14 of the container 11 to support and hang a tool therefrom. Each of the bracket members 50,55 includes a U-shaped main portion 51,56 and planar end portions 52,53,57,58 extending from opposed ends of the U-shaped main portion 51,56. The arcuate rod 60 includes a U-shaped main portion 62 and an inverted L-shaped end portion 65 and an inverted and reversed L-shaped end portion 70. The inverted L-shaped end portion 65 and the inverted and reversed L-shaped end portion 70 are pivotally received between the support plate 50 and the U-shaped main portions 51,56 of the bracket members 50,55 with the U-shaped main portion 62 of the arcuate rod 60 essentially lying in a plane. The inverted L-shaped end portion 65 and the inverted and reversed L-shaped end portion 70 have first sections 66,71 which extend in a same direction as one another and extend perpendicular to the plane within which the U-shaped main portion 62 of the arcuate rod 60 essentially lies, and also have second sections 67,72 which extend perpendicular to the first sections 66,71 and parallel to the plane within which the U-shaped main portion 62 of the arcuate rod 60 essentially lies. The second sections 67,72 extend in opposite directions to one another. The first sections 66,71 of the inverted L-shaped end portion 65 and the inverted and reversed L-shaped end portion 70 are disposed relative to the U-shaped main portion 62 of the arcuate rod 60 such that the first sections 66,71 rest against the support plate 50 and limit downward pivoting of the U-shaped main portion 62 of the arcuate rod 60 to a position where the U-shaped main portion 62 of the arcuate rod 60 is perpendicular to the side wall 14 of the container 11. The tool-hanging assembly relative to the container 11 is disposed approximately 180 degrees from the belt-receiving member 30 and is disposed approximately 90 degrees from the tool-holding pocket 40.

In use, the user inserts the belt 75 through the belt-receiving bore 38 and opens the lid 15 and stores staples inside the container 11 and then closes and fastens the lid 15 over the opening 12 to the container 11. Also, since the user typically uses a cutting knife especially for doing roofing jobs, the user conveniently puts the cutting knife in the tool-holding pocket 40. In addition, in order to use the staples, the user pivots the arcuate rod 60 downwardly and hangs a staple hammer from the arcuate rod 60 for easy access. Since the arcuate rod 60 stays perpendicular to the container 11, the staple hammer will not impress upon the container 11 otherwise causing discomfort and difficulty in removing the staple hammer from the arcuate rod 60.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the belt-carrying tool holder. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A belt-carrying tool holder comprising:

a container assembly including a rigid container having an opening and also including a lid being hingedly attached to said container and being closeable and fastenable over said opening of said container, said lid including a main portion and a downwardly turned lip portion being detachably fastened to said container;

a belt-receiving member being attached to said container;

a tool-holding pocket being attached to said container; and a tool-hanging assembly being pivotally attached to said container, said tool-hanging assembly including a support plate being securely fastened to the exterior of said container, and also including bracket members being spacedly attached to said support plate, and further including an arcuate rod being pivotally supported by said bracket members, said arcuate rod being pivotable upwardly with said arcuate rod essentially resting against a side wall of said container near said opening of said container and also being pivotable downwardly with said arcuate rod being perpendicular to said side wall of said container to support and hang a tool therefrom, each of said bracket members including a U-shaped main portion and planar end portions extending from opposed ends of said U-shaped main portion, said arcuate rod including a U-shaped main portion and an inverted L-shaped end portion and an inverted and reversed L-shaped end portion, said inverted L-shaped end portion and said inverted and reversed L-shaped end portion being pivotally received between said support plate and said U-shaped main portions of said bracket members, said U-shaped main portion of said arcuate rod essentially lying in a plane.

2. The belt-carrying tool holder as described in claim 1, wherein said inverted L-shaped end portion and said inverted and reversed L-shaped end portion have first sections which extend in a same direction as one another and extend perpendicular to said plane within which said U-shaped main portion of said arcuate rod essentially lies, and also have second sections which extend perpendicular to said first sections and parallel to said plane within which said U-shaped main portion of said arcuate rod essentially lies, said second sections extending in opposite directions to one another.

3. The belt-carrying tool holder as described in claim 2, wherein said first sections of said inverted L-shaped end portion and said inverted and reversed L-shaped end portion are disposed relative to said U-shaped main portion of said arcuate rod such that said first sections rest against said support plate and limit downward pivoting of said U-shaped main portion of said arcuate rod to a position where said U-shaped main portion of said arcuate rod is perpendicular to said side wall of said container.

* * * * *